United States Patent [19]

Leussink et al.

[11] 4,100,908

[45] Jul. 18, 1978

[54] SEMICONDUCTOR IGNITION SYSTEM FOR INTERNAL COMBUSTION ENGINES

[75] Inventors: Reinhard Leussink, Vaihingen, Enz; Walter Ruf, Korntal-Munchingen, both of Fed. Rep. of Germany

[73] Assignee: Robert Bosch GmbH, Stuttgart, Fed. Rep. of Germany

[21] Appl. No.: 707,320

[22] Filed: Jul. 21, 1976

[30] Foreign Application Priority Data

Jul. 24, 1975 [DE] Fed. Rep. of Germany ..... 2533082

[51] Int. Cl.[2] ..... F02P 3/04; F02P 3/00

[52] U.S. Cl. ..... 123/148 E; 123/148 S

[58] Field of Search ..... 123/148 E, 148 S

[56] References Cited

U.S. PATENT DOCUMENTS

| | | | |
|---|---|---|---|
| 3,703,889 | 11/1972 | Bodig et al. | 123/148 S |
| 3,745,985 | 7/1973 | Höhne | 123/148 S |
| 3,854,466 | 12/1974 | Steinberg et al. | 123/148 S |

*Primary Examiner*—Verlin R. Pendegrass
*Assistant Examiner*—Thomas H. Webb
*Attorney, Agent, or Firm*—Flynn & Frishauf

[57] ABSTRACT

To provide for gradual decay of current flow through the primary of an ignition coil, and hence suppression of spurious sparks at spark plugs, a main switching transistor has its conductivity controlled by the conductivity of the emitter-collector path of a control transistor, the base-emitter path of which forms part of a discharge circuit of a control capacitor, which discharge circuit has a sufficiently high resistance to provide for gradual discharge of the capacitor and hence gradual transition of the conductivity of the control transistor.

11 Claims, 2 Drawing Figures

SEMICONDUCTOR IGNITION SYSTEM FOR INTERNAL COMBUSTION ENGINES

CROSS REFERENCE TO RELATED APPLICATION

Figure 1:
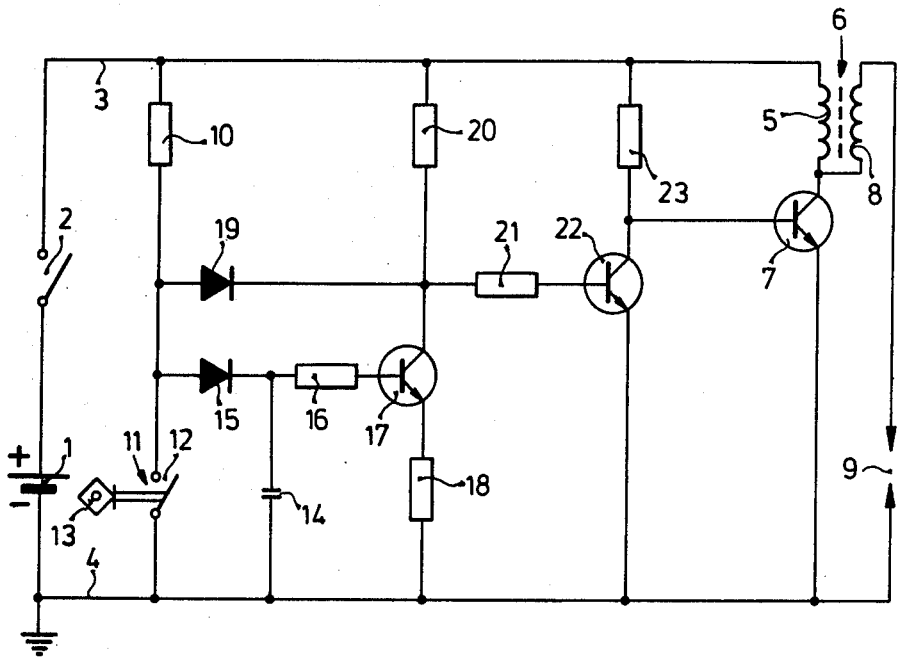

U.S. Ser. No. 707,323, filed July 21, 1976, by Jundt et al, and assigned to the assignee of the present application.

The present invention relates to a semiconductor-type ignition system for internal combustion engines, and more particularly to a transistorized ignition system having an ignition coil, in which the emitter-collector path of an ignition transistor supplies current to the coil and a circuit is provided to gradually change conductivity of the main transistor if the engine should be stopped while the transistor is in conductive state.

Transistorized ignition system in which a transistor switch is provided preferably include a circuit to change the transistor control switch to blocked or non-conductive state when the engine is stopped, so that current flow through the ignition coil is inhibited, thus preventing excessive heating and possible destruction thereof.

It has previously been proposed (see U.S. Pat. No. 3,745,935) to provide a control capacitor which is constantly charged and discharged in synchronism with controlled ignition events during operation of the internal combustion (IC) engine. When the IC engine stops, and no further ignition events should occur, the voltage at the control capacitor can rise suddenly to such an extent that the threshold value of a Zener diode is exceeded, thus providing current to the base-emitter path of a control transistor which renders the control transistor conductive; the control transistor, in turn, is connected in a circuit which controls the main switching transistor to change to blocked state. This interrupts current flow through the primary of the ignition coil, but does so in such a short period of time that an additional spark can be generated. This additional spark may cause the engine to continue to operate, that is, to start again, without any intention on the operator to provide for continued engine operation.

It is an object of the present invention to provide a semiconductor, typically transistorized ignition system in which undesired ignition events are reliably inhibited, while still providing for turn-off of current flow through the primary of the ignition coil regardless of the position of the breaker switch when the engine is being stopped.

SUBJECT MATTER OF THE PRESENT INVENTION

Briefly, a main switching transistor is connected in series with the primary of the ignition coil. Ignition events are controlled by an ignition breaker switch which may be a cam-controlled, a contactless switch, or the like; a control capacitor is connected to the main switching transistor to control it to non-conduction or blocked state if the engine should be stopped, with the ignition breaker switch closed. In order to prevent spuriously induced currents in the secondary of the ignition coil, a capacitor discharge circuit is connected to the base-emitter path of a control transistor, the collector-emitter path of which is connected to control, in turn, the conductivity of the main switching transistor. As the control transistor gradually changes state, upon gradual discharge of the capacitor, the main switching transistor, likewise, is controlled to gradually change to blocked condition so that the induced voltage in the secondary of the coil will not rise to a level sufficient for arc-over at the spark plug.

Figure 2:
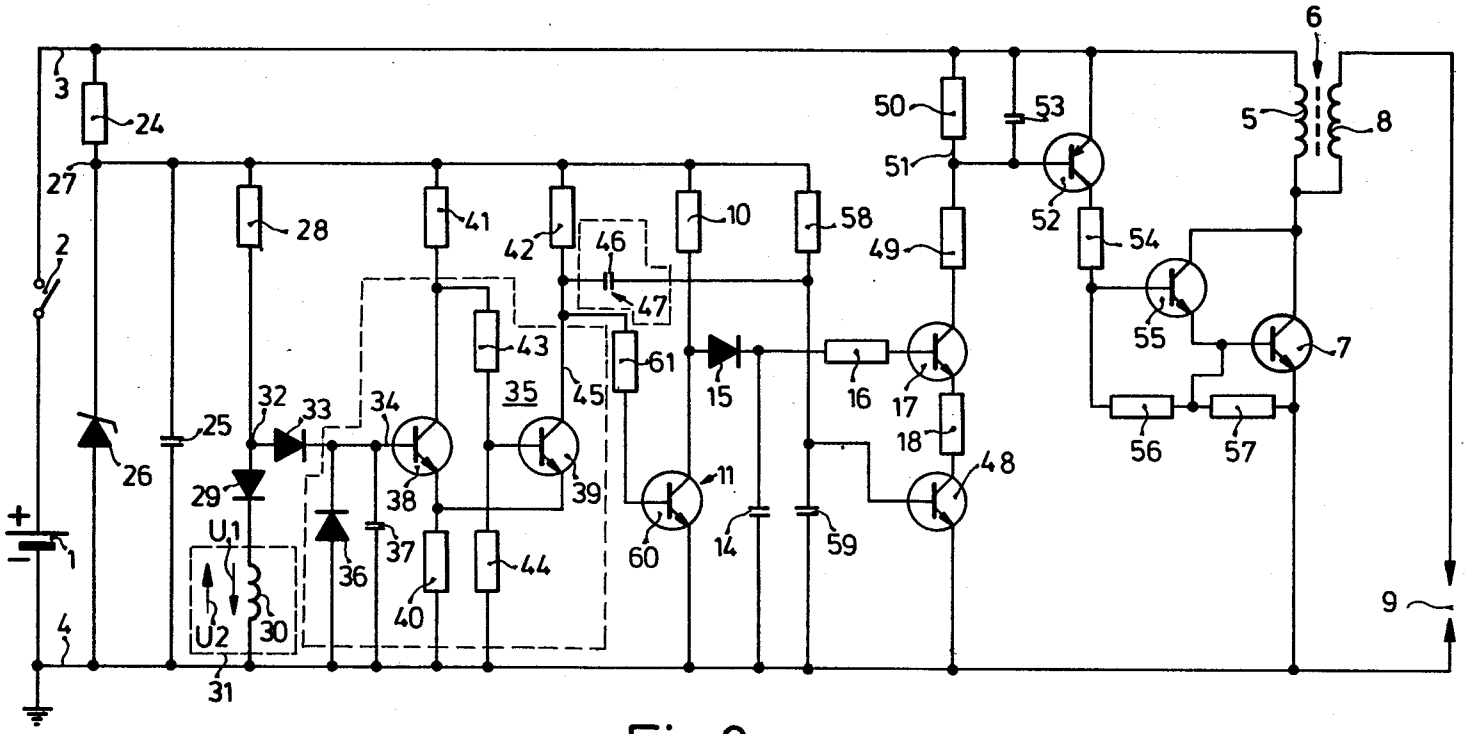

The invention will be described by way of example with reference to the accompanying drawings, wherein:

FIG. 1 is a simplified schematic circuit diagram illustrating the necessary main elements of a circuit in accordance with the present invention; and FIG. 2 is a more detailed circuit diagram illustrating a different embodiment and using a contactless ignition control system.

The ignition system is intended for use with an internal combustion engine (not shown), particularly an automotive internal combustion engine. This system is supplied from a current source 1, which may be the vehicle battery. The positive terminal of the battery is connected through an ignition switch 2 to a positive bus 3; the negative terminal is connected to ground or chassis, indicated as bus 4. The positive bus 3 is connected to the primary 5 of an ignition coil 6 and then through the emitter-collector path of main ignition transistor 7, the emitter of which is connected to chassis 4. Secondary 8 of the ignition coil 6 is connected to a spark plug 9 and, if the engine is a multi-cylinder engine, a distributor is interposed between the secondary 8 and the various spark plugs, as well known.

Transistor 7 is controlled by a control circuit connected between buses 3 and 4. A resistor 10 is serially connected through a switch 11 to bus 4. Switch 11 is illustrated as a make-break mechanical switch, which is usually the breaker contact 12 of a mechanically controlled ignition breaker assembly, the opening and closing of which are commanded by rotation of a cam 13, rotating in synchronism with the rotation of the engine (not shown).

The junction between switch 11 and resistor 10 is connected to a branch circuit including capacitor 14. A diode, poled in current-conductive direction with respect to source 1, is connected between the junction of resistor 10 and switch 11 and capacitor 14. The capacitor 14, which monitors the conduction state of transistor 7, has a discharge circuit associated therewith which includes a resistor 16 and the base-emitter circuit of an npn transistor 17 and is connected through the resistor 18 to chassis bus 4. The collector of the monitoring transistor 17 is connected to the cathode of a blocking diode 19, poled in current-passing direction with respect to current source 1. The collector of transistor 17 is further connected through resistor 20 to bus 3 and through resistor 21 to the base of a coupling transistor 22. Coupling transistor 22 has its emitter connected to chassis bus 4, its collector to collector resistor 23 and then to positive bus 3 and further to the base of transistor 7.

Operation: The system is ready to operate as soon as switch 2 is closed. Upon closing of breaker switch 12, the emitter-collector path of coupling transistor 22 is changed to blocking state. Control current can thus flow over resistor 23 to command transistor 7 to change to conductive state so that the emitter-collector path thereof will be of low resistance and current will flow through primary winding 5 to store ignition energy in ignition coil 6. Resistor 20 and the emitter-collector path of the monitoring transistor 17, as well as resistor 18 from a phantom voltage divider; the emitter-collector path of transistor 17 is commanded to a predetermined conductance by the charge state of capacitor 14.

When the switch 12 is closed, the voltage at the base of transistor 22 is so set by suitable proportioning of the resistance value of resistor 20, resistor 18 and the reflected resistance of transistor 17, that the emitter-collector path of transistor 22 is blocked.

The switch 12 opens at the ignition instant. At that moment, blocking diode 15 starts to re-charge capacitor 14 in order to hold the value of the second partial resistance of the voltage divider formed by the transfer resistance of transistor 17 and of resistor 18 within design limits. As soon as switch 12 opens, however, the series circuit formed by the diode 19 and resistor 20 is placed in parallel, causing the voltage applied to the base of the coupling transistor to rise in positive direction to such a value that the emitter-collector path thereof becomes conductive, thus short-circuiting the base-emitter path of the main ignition transistor 7, which, in turn, controls transistor 7 to block. Due to interruption of the current flowing through the primary winding 5, a high-voltage pulse is induced in the secondary 8 of ignition coil 6, resulting in a spark at the spark plug 9.

Upon re-closing of switch 12, the cycle will repeat.

If the engine now is stopped, with the ignition switch 2 closed and switch 12 also, per chance, closed, so that current can flow over the primary, the resistance of the collector-emitter path of transistor 17 will increase as the capacitor 14 discharges through resistor 16, the base-emitter path of transistor 17 and resistor 18, without being re-charged due to subsequent opening of switch 12. This causes a gradual rise of the voltage at the base of the transistor 22 in positive direction which, in turn, causes a gradual increase in the conductivity of the emitter-collector path of transistor 22. In dependence thereon, the emitter-collector path of the main ignition transistor 7 gradually changes into blocking state. Current flowing through primary 5 thus is automatically disconnected but not abruptly, but rather gradually, so that no ignition pulse will be induced in the secondary 8 of ignition coil 6.

Embodiment of FIG. 2: Basically, the difference between the system of FIG. 2 and the embodiment of FIG. 1 is the triggering of the ignition event; in FIG. 2, a contactless triggering system is shown, replacing the mechanical breaker switch 11. Similar elements and operating similarly have been given the same reference numerals. Thus, the embodiment of FIG. 2 can be considered to be the same as that of FIG. 1, with the ignition breaker switch now being a contactless breaker switch, rather than a mechanically operated one.

FIG. 2 shows a branch circuit branched off by a resistor 24 from main positive bus 3. The resistor 24 is connected to a parallel circuit of a capacitor 25 and a Zener diode 26, poled in blocking direction with respect to source 1. The junction of Zener diode 26 and capacitor 25 with the resistor 24 thus forms a junction point or bus 27 which has a stabilized control voltage thereat. Stabilized voltage junction 27 provides a stabilized voltage output to a resistor 28 which is connected to a diode 29, poled in conductive direction with respect to battery 1 and which is then connected to a transducer winding 30 and then grounded.

Transducer winding 30 is a component of a transducer unit 31, shown schematically in box form only, and which is magnetically coupled in operation to a rotating portion of the internal combustion engine, and operates similarly to a permanent magnet a-c generator. In operation of the engine, approximately sinusoidal voltages are induced in transducer unit 31; polarities of the voltages are indicated by the arrows U1 and U2, arrow U1 illustrating the negative half wave and arrow U2 the positive half wave of the output.

A diode 33 is connected to the junction 32 between resistor 28 and diode 29. The cathode of diode 33 is connected to a threshold switch 35, operating similarly to a Schmitt trigger. It is additionally connected to the parallel circuit of a diode 36 and a capacitor 37; diode 36 and capacitor 37 bypass noise pulses and are connected to ground or chassis bus 4.

The threshold switch 35 has an npn input transistor 38 and an npn output transistor 39. Both transistors 38, 39 have their emitters connected to a common emitter resistor 40 and then to chassis bus 4. The collectors of the transistors 38, 39 are connected through respective collector resistors 41, 42 to the stabilized voltage bus 27. The base of the output transistor 39 is connected to the junction or tap point of a voltage divider formed by resistors 43, 44, resistor 43 being connected to the collector of input transistor 38. Diode 36 also protects the base-emitter path of the input transistor 38.

The output 45 of the Schmitt trigger, or threshold switch 35 is connected to a storage circuit 47 formed by a capacitor 46 and then to the base of a coupling transistor 48.

Coupling transistor 48, the emitter of which is connected to chassis bus 4, has its collector connected to the resistor 18 which, in turn, is connected to the emitter of the monitoring transistor 17. The collector of transistor 17 is connected to the series circuit of two resistors 49, 50 forming a voltage divider, the tap or junction point 51 of which is connected to the base of a pnp coupling transistor 52. The emitter of transistor 52 is connected to positive bus 3. A filter capacitor 53, in parallel with the base-emitter junction, protects against stray pulses. The collector of coupling transistor 52 is connected through a resistor 15 with the base of a driver transistor 55 which, together with the main ignition transistor 7, forms a Darlington circuit. The collectors of transistors 7 and 55 are connected together; the base-emitter junction of driver transistor 55 is bridged by a resistor 56, and the base-emitter junction of main transistor 7 is bridged by a resistor 57, as shown in FIG. 2.

The transistor 48 has its base connected to a resistor 58 and hence to the source of stabilized voltage, that is, junction 27. A filter capacitor 59 filters stray pulses.

In the embodiment of FIG. 2, the control switch 11 is formed by the emitter-collector path of the npn transistor 60, the emitter of which is connected to the grounded or chassis bus 4, and the collector to the anode of blocking diode 15 as well as to collector resistor 10 and then to the source of stabilized voltage 27. The cathode of blocking diode 15 is connected to the monitoring capacitor 14 and to coupling resistor 16 and then to the base of the monitoring transistor 17. The base of the breaker transistor 60, forming the switch 11, is connected through a resistor 61 to the collector of the Schmitt trigger output transistor 39, that is, is connected to the output 45 of threshold switch 35.

Operation of the circuit of FIG. 2: The system is ready to operate when ignition switch 2 is closed. Let is be assumed that, at that particular instant, a positive voltage half wave as indicated by arrow U2 is provided by the transducer coil 30. Due to the presence of diode 29, input transistor 38 of the threshold switch 35 is not controlled by this half wave. A control current will thus flow through transistor 38 over the base-emitter path which is determined by the circuit elements of the following series circuit: Battery 1 — switch 2 — bus 3 — resistor 24 — stabilized voltage junction 27 — resistor 28 — internal resistance of diode 33 — base-emitter junction of transistor 38 — resistor 40 — negative bus 4. The current through this circuit causes transistor 38 to become conductive. As a consequence, the emitter-collector path of output transistor 39 will be blocked. The coupling transistor 48 will then also have a base-emitter current flowing therethrough which can be traced through the following network: Battery 1 — switch 2 — bus 3 — resistor 24 — stabilized voltage bus 27 — resistor 58 — base-emitter junction of transistor 48 — bus 4. The emitter-collector path of transistor 48 will thus become conductive. Current will divide through resistor 42 and capacitor 46 forming the storage circuit so that capacitor 46 will charge to a predetermined storage state.

When the coupling transistor 48, due to the charge on monitoring capacitor 14, and hence the emitter-collector path of the monitoring transistor 17 are in conductive state, the base-emitter path of coupling transistor 52 will carry control current. Its emitter-collector path will be conductive. Voltage drops will arise due to the current flow through the following circuit: Battery 1 — switch 2 — bus 3 — emitter-collector path of transistor 52 — resistor 54 — resistors 56, 57 — bus 4. These voltage drops control the emitter-collector path of the driver transistor 55 as well as that of the main ignition transistor 7 to be conductive. Primary winding 5 is supplied with current from current source 1, and ignition coil 6 will store ignition energy.

Output transistor 39 has a non-conductive or blocked emitter-collector path. The emitter-collector path of the transistor 60 of switch 11 thus, likewise, is closed or conductive.

Upon change in inductive coupling of magnetic flux to coil 30 of transducer 31, a negative half wave, as illustrated by arrow U1, will occur. The voltage at junction 32 will become negative until input transistor 38 will no longer have control current flow therethrough. Control current will then flow through the base-emitter path of the output transistor 39 of threshold circuit 35. The current path will be as follows: Switch 2 — bus 3 — resistor 24 — stabilized voltage bus 27 — resistor 41 — resistor 43 — base-emitter junction of transistor 39 — resistor 40 — bus 4. The emitter-collector path of transistor 39 will thus become conductive. Conduction of transistor 39 causes discharge of capacitor 46 forming the storage or memory element 47 through resistor 58 and the emitter-collector path of output transistor 39 as well as resistor 40. The voltage at the base of coupling transistor 48 will then shift in negative direction to such an extent that its emitter-collector path will become blocked, causing the emitter-collector path of coupling transistor 52, the emitter-collector path of driver transistor 55 and hence the emitter-collector path of main ignition transistor 7 to block. This sudden and rapid interruption of current flow through primary 5 of coil 6 causes a high-voltage pulse in the secondary 8 and sparking at spark plug 9.

After some time interval, which is predetermined by the capacity of capacitor 46 forming the storage unit 47, coupling transistor 48 again become conductive since the voltage at its base will again rise in positive direction. Upon change to conduction, the emitter-collector path of the coupling transistor 52 and hence the emitter-collector paths of transistors 55 and 7 will become conductive and current flow through the primary winding 5 of coil 6 will again resume, even before the transducer 30 has lost all induction from the moving magnetic element coupled thereto and still has a negative voltage appear thereat, although with decreasing intensity as the negative half wave declines to zero. Thus, current flow will commence even before the emitter-collector path of the input transistor 38 becomes conductive, hence rendering the emitter-collector path of output transistor 39 non-conductive. Capacitor 46 will recharge so that the cycle can be repeated.

While the emitter-collector path of transistor 39 is conductive, the emitter-collector path of transistor 60 forming part of the switch 11 is non-conductive, so that this interval may be used to re-charge the monitoring capacitor 14. As a consequence, the emitter-collector path of monitoring transistor 17 is constantly ready during operation of the internal combustion engine to permit current flow for the coupling transistor 52 if commanded to do so due to conduction of the coupling transistor 48.

If the IC engine is stopped but ignition switch 2 is closed, re-charge of capacitor 14 will not occur since no further ignition events are commanded. The monitoring capacitor 14 will thus gradually and slowly discharge over resistor 16, the base-emitter path of transistor 17, resistor 18, and the emitter-collector path of transistor 48. As a result, the emitter-collector path of monitoring transistor 17 will gradually throttle the control current for the base-emitter path of coupling transistor 52. As a consequence, the emitter-collector path of coupling transistor 52, the emitter-collector path of driver transistor 55 and hence the emitter-collector path of the ignition transistor 7 will also gradually change to current-blocking state. Thus, if the engine is stopped, with the ignition switch 2 closed, current flow through primary winding 5 is inhibited, the current flow being, however, disconnected gradually so that high-voltage pulses are not induced in the secondary of coil 6.

Transistor 7 may, of course, itself form the driver unit of a further Darlington-connected transistor.

If the ignition switch 2 is closed and the engine does not operate at all, monitoring capacitor 14 will not have any charge applied thereto and thus no current can flow through the primary winding at all. This effect will obtain in both the embodiments of FIGS. 1 and 2.

Various changes and modifications may be made within the scope of the inventive concept.

We claim:

1. Semiconductor ignition system for an internal combustion engine comprising an ignition coil (6);

a main switching transistor (7) connected in series with the primary (5) of the ignition coil (6);

an ignition breaker switch (11) connected to and controlling conduction or blocking of the switching transistor (7) in accordance with commanded ignition events;

a control circuit including a control capacitor (14) and a control transistor (17) connected to the switching transistor (7) to control the switching transistor to non-conduction or blocked state if the engine should be stopped with the ignition breaker switch (11) closed, and a capacitor discharge circuit (16, 18;) for the control capacitor (14) dimensioned for gradual discharge of the capacitor, and connected to the base-emitter path of the control transistor (17), the collector-emitter path of the control transistor being connected to control conductivity of the switching transistor (7) so that discharge of the control capacitor (14), gradually, through said base-emitter path of the control transistor (17) will gradually change the conductivity of its collector-emitter path and hence provide for gradual change of conductivity of the main switching transistor (7) and gradual change-over to blocked state thereof and hence prevent generation of a high-voltage pulse in the secondary (8) of the coil (6).

2. System according to claim 1, wherein an ignition command circuit (10, 11) is provided including a resistor (10) and said ignition breaker switch (11) connected across a source of supply (1);

and a branch circuit is connected from said ignition command circuit supplying charge energy to said control capacitor (14).

3. System according to claim 2, wherein said branch circuit includes a blocking diode, poled in conductive direction with respect to the source of current supply (1) and transmitting charging energy to said control capacitor (14) but preventing discharge thereof through the source of current supply (1).

4. System according to claim 3, wherein the capacitor discharge circuit (16, 18;) starts at the blocking terminal of the blocking diode (15).

5. System according to claim 1, wherein the capacitor discharge circuit includes a resistor (16) connected between the control capacitor (14) and the base-emitter junction of the control transistor (17).

6. System according to claim 1, further comprising a circuit connection (10, 15) common to said ignition breaker switch (11), a source of current supply (1, 27) and said control capacitor (14) to re-charge the control capacitor upon closing of said ignition breaker switch (11) controlling cyclically repetitive ignition events, re-charge of said control capacitor occurring upon each switching operation of said ignition breaker switch (11).

7. System according to claim 6, wherein said circuit connection includes a charge control resistor (10) supplying charge current to said control capacitor upon each switching operation of said ignition breaker switch.

8. System according to claim 1, wherein (FIG. 1) said ignition breaker switch is a mechanically operated breaker switch controlled by a cam (13) coupled to the internal combustion engine.

9. System according to claim 1, wherein (FIG. 2) the ignition breaker switch (11) comprises the emitter-collector path of an ignition breaker transistor (60);

and circuit means (31, 33, 35) controlling conduction of the emitter-collector path of said ignition breaker transistor (60).

10. System according to claim 1, wherein (FIG. 2) the ignition breaker switch (11) includes a contactless transducer (30) and semiconductor switching means (60) connected to and controlled by said transducer and changing switching state in accordance with induced voltages in said transducer, generated as induction voltages upon rotation of the engine.

11. System according to claim 1, wherein (FIG. 2) the ignition breaker switch comprises a contactless transducer (31), a semiconductor switch (60) and threshold circuit means (29, 35) connecting said transducer to said semiconductor switch (60) and controlling the switching state thereof in accordance with the angular position of an element of said engine upon rotation thereof.

* * * * *